US005235716A

United States Patent [19]

Stella

[11] Patent Number: 5,235,716

[45] Date of Patent: Aug. 17, 1993

[54] GOLF CLUB CLEANING DEVICE

[76] Inventor: Steve Stella, 674 Alameda Ave., Cuyahoga Falls, Ohio 44221

[21] Appl. No.: 843,424

[22] Filed: Feb. 28, 1992

[51] Int. Cl.[5] ..... A46B 13/02

[52] U.S. Cl. ..... 15/23; 15/28; 51/170 PT; 464/30

[58] Field of Search ..... 15/23, 24, 28, 29, 22.1; 51/170 R, 170 PT, 170 T, 170 MT, 171, 173; 403/DIG. 3; 464/30

[56] References Cited

U.S. PATENT DOCUMENTS

| | | | |
|---|---|---|---|
| 1,854,626 | 4/1932 | Riggall, Jr. | 15/23 |
| 3,080,735 | 3/1963 | Blom, Jr. et al. | 464/30 |
| 3,407,431 | 10/1968 | Melnik | 15/23 |
| 3,848,336 | 11/1974 | Copeland | 15/28 |
| 3,987,549 | 10/1976 | Robertelli | 15/23 |
| 4,137,588 | 2/1979 | Sandt et al. | 15/23 |
| 4,845,796 | 7/1989 | Mosley | 15/23 |

FOREIGN PATENT DOCUMENTS

| | | | |
|---|---|---|---|
| 651108 | 10/1928 | France | 15/23 |

*Primary Examiner*—Edward L. Roberts
*Attorney, Agent, or Firm*—Oldham, Oldham & Wilson Co.

[57] ABSTRACT

A direct current powered golf club cleaning device which incorporates a housing configured to fit into the palm of a hand, the housing having a recessed region adapted to accept at least one battery inside the housing. The device is powered by a battery operated motor located inside the housing which has a shaft extending from the front of the motor and through the housing. A safety slip sleeve attaches by frictional engagement onto the shaft of the motor at the first end of the sleeve and a removable cleaning head attaches at the second. The device is activated by a switch having an electrically open first and an electrically closed second position.

16 Claims, 1 Drawing Sheet

GOLF CLUB CLEANING DEVICE

TECHNICAL FIELD

This invention relates to a hand-held, direct current powered golf club cleaning device. This device incorporates a motor burnout safety feature by incorporating a slip sleeve which enables the motor armature and shaft to continue to rotate even when the cleaning head is held motionless, such as would occur when the cleaning head encounters a crusted deposit of material on a golf club head or too much pressure is applied to the surface of the golf club face by the user. The slip sleeve is also designed to permit the facile interchange of the cleaning head to accommodate bristle brush heads through buffing operations.

BACKGROUND OF THE INVENTION

The sport of golf is an activity which enjoys widespread popularity. The skill level of its participants range from the highly skilled professional to the weekend "duffer". However, it is recognized that no matter what the skill level, clean golf clubs will maximize the potential for the golfer to hit the straightest shot that they are capable of.

Unlike many sports, avid golfers actively engage the game under adverse conditions. The potential for acquiring a build-up of grass and soil on the golf club face is quite significant, even under perfect conditions. Current methods of cleaning the golf club face, such as by using a towel or other such cleaning material are quite incapable of removing debris from the grooves which are in the golf club face. It is these grooves which enable a golfer to accurately control the shot. When these grooves are filled in with debris, the control is thereby significantly diminished, leading to frustrating rounds of golf.

Another commonly seen cleaning method on golf courses is the use of the pointed end of a wooden or plastic tee to physically remove debris from the grooves in the club face. This method is marginally more effective than wiping, but is still quite unsatisfactory.

SUMMARY OF THE INVENTION

It is an object of this invention to provide a hand-held, direct current powered golf club cleaning device.

It is a second object of this invention to provide the golf club cleaning device with a motor burnout safety feature by incorporating a slip sleeve which enables the motor armature and shaft to continue to rotate even when the cleaning bristles are held motionless.

It is a third object of this invention to provide the golf club cleaning device with a slip sleeve which is adapted to accept various cleaning heads.

It is a fourth object of this invention to produce the golf club cleaning device inexpensively.

These and other objects of this invention will be evident when viewed in light of the drawings, detailed description, and appended claims.

DETAILED DESCRIPTION OF THE DRAWINGS

DETAILED DESCRIPTION OF THE INVENTION

Figures 1, 2, 3, 4:
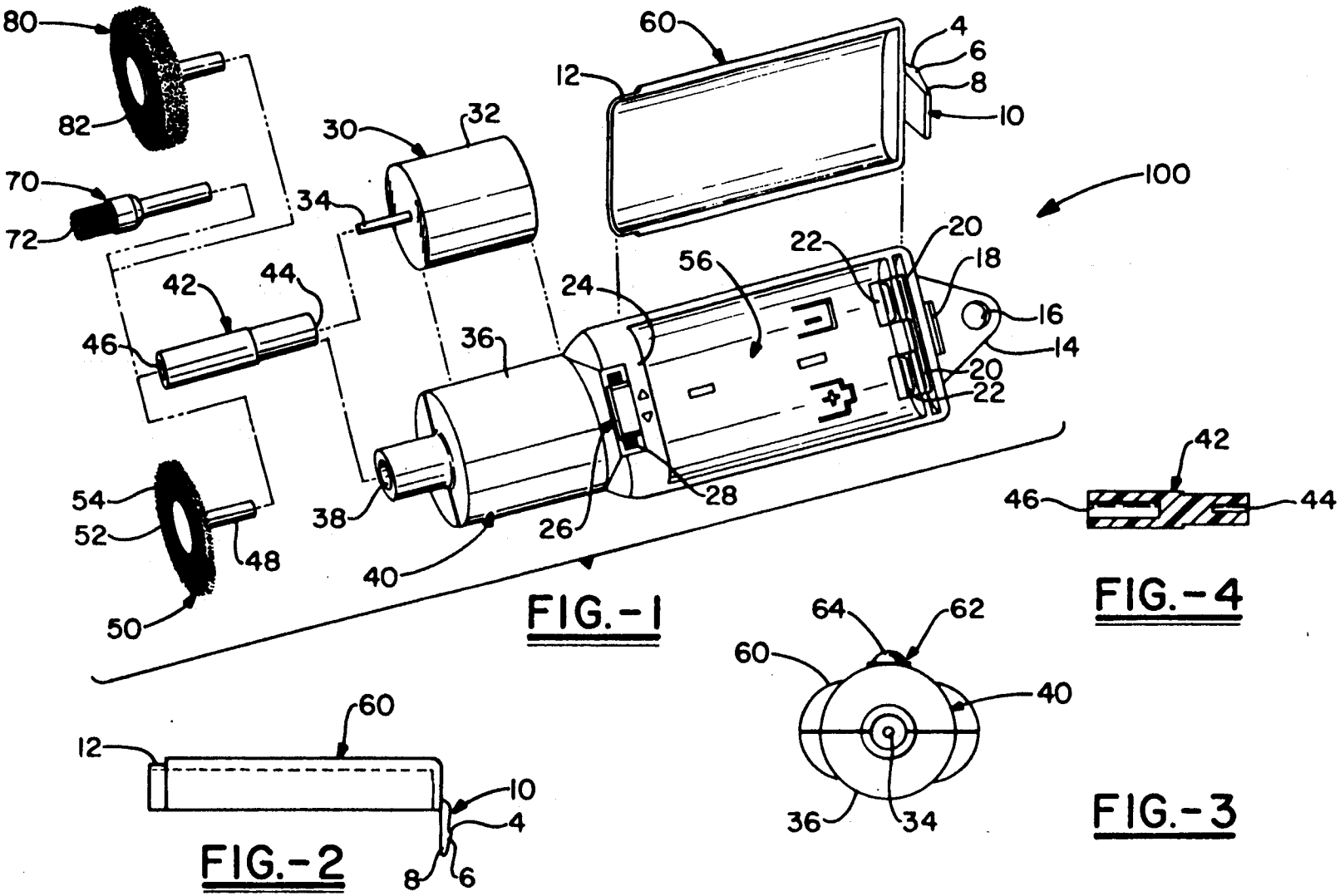
FIG. 1 is a perspective assembly view of the golf club cleaning device's component parts.
FIG. 2 is a side elevational view of the removable cover illustrating the rear tab extension.
FIG. 3 is a front elevational view of a push button on/off switch on the golf club cleaning device.
FIG. 4 is a side elevational view in cross-section, of the slip sleeve.

As seen in FIG. 1, golf club cleaning device (100) is comprised of several component parts; housing (40), motor (30), slip sleeve (42), cleaning head (50) and on/-off switch (26). Preferably, a direct current (dc) power source, (e.g. batteries, not shown) would be positioned in recess (56).

Housing (40) is typically of polymeric construction. The choice of material is one of convenience and typically a thermoplastic polymer is used. There is of course, no reason why metallic materials could not be used, except for raw material costs and ease of fabrication concerns. Housing (40) has a removable cover (60). This cover is slidably engaged with overlapping segments (12) and (24). Cover (60) is held into place by tab extension (10) at the rear of the cover. As best illustrated in FIG. 2, tab extension (10) is configured with a tapered region (8) which becomes progressively thicker to its maximum thickness at thickened section (6). The size of thickened section (6) is governed by the size of opening (18). Retaining segment (4) is created between thickened section (6) and the base of cover (60).

Tab extension (10) is slidably inserted into receiving slot (18) by first engaging tapered region (8) with slot (18) and continuing to press the tab extension through the slot, thereby allowing thickened section (6) to pass through and allowing retaining segment (4) to snap into position.

Housing (40) has a pair of electrically-connected contacts (22) at the rear of housing (40), the contacts being held in place by the frictional fit of contacts (22) in rear-recess (20), and a pair of electrical contacts (not shown) at the front. A direct current power source is positioned in recess (56). This direct current power source is normally a battery, or a plurality of batteries. It of course, is known in the art, that any direct current operated device can be powered by alternating current by the use of an alternating current adapter.

The device is operated by employing lateral on/off switch (26) which extends through housing (40) through forward-recess (28). This switch is normally in the open position. When the switch is laterally moved to the opposed closed position, the electrical circuit is completed and current flows to electrical motor (30). It is envisioned that alternative arrangements are possible for the switch mechanism. In one such alternative embodiment shown in FIG. 3, a push button on/off switch (62) is envisioned. The push button switch would be biased in the open vertical position (64). Pressure exerted by the user on the push button switch would move the switch to the closed second position by completing the circuit. The current is stopped by releaving the pressure on the button switch. The biasing means is normally a spring, although other biasing means are envisioned.

Electrical motor (30) typically operates between 1.5–9.0 volts. In a more preferred embodiment, the motor operates between 1.5–3.0 volts. With no load imposed on the motor, it generates from 3,000–10,000 rpm with a stall torque between 0.5–2.4 oz.-in. In a more preferred embodiment, the stall torque is between 1.5–2.0 oz.-in. It is well known in the art that larger or smaller motors could be used in this application. Protruding from housing (40) at frontal opening (38) is shaft (34) of motor (30). While in a preferred mode, motor (30) is a single speed motor, it is well-known in the art to incorporate variable speed motors into the device.

When a variable speed motor is incorporated into the device, either lateral on/off switch (26) or push button on/off switch (62) must be capable of performing more than an on/off function. In one embodiment, the switch will have at least two electrically closed positions. As the switch is moved from the electrically open first position into an adjacent electrically closed second position, the motor will operate at a pre-set number of revolutions per minute (rpm). As the switch is progressively moved away from the electrically open first position, the motor accelerates to operate an an increased number of revolutions per minute.

There of course, is no reason to require the motor to operate at discrete rpm increments, and in another embodiment, the motor will operate at increasingly higher rpm values as the on/off switch is moved from to further distances from the initial electrically open first position.

Safety slip sleeve (42) is frictionally attached to the extremity of shaft (34) at a first bore hole (44). The diameter of shaft (34) is designed so as to fit tightly into shaft first bore hole (44). Slip sleeve (42) additionally has a second bore hole (46) which is similarly designed to frictionally attach to cleaning head shaft (48). As shown in FIG. 4, bore holes (44,46) partially extend longitudinally into slip sleeve (42). These bore holes may be of different diameters. In an alternative configuration, bore holes (44,46) are interconnected. Slip sleeve (42) is typically of polymeric construction. In a preferred embodiment, this material is a nylon, which may be glass-reinforced. The unique capacity of the polymeric slip sleeve to permit rotation of shaft (34) while cleaning head shaft (48) is stationary is what prevents motor (30) from premature burnout.

In one embodiment, rotating cleaning head (50) has a plurality of radially extending bristles (54) about its circumference (52) and is attached to slip sleeve (42) through cleaning head shaft (48). In a second embodiment, the rotating cleaning head (70) has a plurality of axially extending bristles (72) protruding from the front of the cleaning head. Rotating cleaning head (50) is capable of removing accumulated debris which tends to fill in the grooves in the club face. Subsequent to debris removal, in a third embodiment, the rotating cleaning head can be removed from slip sleeve (42) and polishing wheel (80) with a plurality of softer bristles (82) is used to buff the golf club face. The bristles are chosen such that they do not mar the surface of the golf club head when applied to the surface. While it is possible to use natural bristles, it is usually more cost effective to use polymeric bristles. In a preferred embodiment, nylon bristles are used.

If desired, or as becomes necessary due to repeated installation and removal of cleaning head (50), an optional set screw is inserted longitudinally into slip sleeve (42) to prevent excessive slippage by cleaning head shaft (48) in slip sleeve's second bore hole (46). Even in this configuration, slip sleeve (42) is still effective in preventing premature motor burnout by the free rotation of shaft (34) in first bore hole (44) of slip sleeve (42).

For ease of attachment to any suitable object, such as a golf cart, housing (40) has a rear-attachment extension (14) with aperture (16) suitable for threading a string or cord therethrough.

What is claimed is:

1. A motorized, hand-held golf club cleaning device for cleaning debris from a golf club, which comprises:
   (a) a closed housing having a recessed region therein;
   (b) a motor inside a front end of the housing driven by a power source inside a rear end of the housing, the motor having a shaft extending from a front of the motor and through the front end of the housing;
   (c) a nylon slip sleeve having a first and a second axial bore hole partially extending through the sleeve at a fist and a second end respectively, the first bore hole having a diameter to permit frictional engagement of the shaft at a first end of the sleeve thereby permitting rotation of the shaft without a corresponding rotation of the slip sleeve when a torque force generated by a rotation speed of the shaft exceeds frictional force of attachment due to the lubricity of the nylon;
   (d) a removable cleaning head having a cleaning head shaft with a diameter to permit frictional engagement of the slip sleeve with the second bore hole at the second end of the slip sleeve thereby permitting rotation of the slip sleeve without a corresponding rotation of the cleaning head shaft, when a stall force generated by the debris on the golf club exceeds the frictional engagement force of the slip sleeve with the second bore hole at the second end of the slip sleeve due to the lubricity of the nylon; and
   (e) a switch having an electrically open first and an electrically closed second position, the switch activating the motor when in the second position and disengaging the motor when in the first position.

2. The device of claim 1 wherein the cleaning head has a plurality of bristles about a circumference of the cleaning head which are polymeric.

3. The device of claim 2 wherein the bristles of the cleaning head are nylon.

4. The device of claim 1 wherein a plurality of bristles extend radially about the circumference of the cleaning head.

5. The device of claim 1 wherein a plurality of bristles extend axially about the circumference of the cleaning head.

6. The device of claim 1 wherein the cleaning head is a polishing wheel.

7. The device of claim 1 wherein the switch is a lateral on/off switch.

8. The device of claim 1 wherein the switch is a vertical on/off switch, the switch being selectively biased to the electrically open position.

9. The device of claim 1 wherein the first and second axial bore holes in the slip sleeve are interconnected.

10. The device of claim 9 wherein the first and second axial bore holes are of a same diameter.

11. The device of claim 1 wherein the power source is a direct current power source.

12. The device of claim 1 wherein the power source is a battery.

13. The device of claim 1 wherein the motor is a single speed motor.

14. The device of claim 1 wherein the motor is a variable speed motor.

15. The device of claim 14 wherein the switch has an electrically open first position and at least two electrically closed positions, the closed positions activating and increasing the speed of the motor as the switch is moved in a direction away from the open first position and disengaging the motor when in the first position.

16. The device of claim 14 wherein the switch has an electrically open first position and a continuum of closed positions, the closed positions activating and increasing the speed of the motor as the switch is moved in a direction away from the open first position and disengaging the motor when in a first position.

* * * * *